United States Patent [19]

Milbright

[11] 4,388,787

[45] Jun. 21, 1983

[54] POLE CONSTRUCTION

[75] Inventor: Arnold M. Milbright, Redwing, Minn.

[73] Assignee: International Telephone and Telegraph Corporation, New York, N.Y.

[21] Appl. No.: 274,299

[22] Filed: Jun. 16, 1981

Related U.S. Application Data

[63] Continuation of Ser. No. 43,729, May 30, 1979.

[51] Int. Cl.[3] ..... E04H 12/22; E02D 27/42

[52] U.S. Cl. ..... 52/298

[58] Field of Search ..... 52/726, 296, 298, 724, 52/725, 727, 40; 405/231, 250, 251-256

[56] References Cited

U.S. PATENT DOCUMENTS

| | | | |
|---|---|---|---|
| 239,080 | 3/1881 | Baker | 52/298 |
| 724,573 | 4/1903 | Hartung et al. | 52/725 |
| 775,518 | 11/1904 | Bruley | 52/725 |
| 930,607 | 8/1909 | Morrill | 52/165 |
| 969,136 | 8/1910 | Cranford | 405/250 |
| 1,073,614 | 9/1913 | McDearmid | 52/726 |
| 1,523,977 | 1/1925 | Pillar | 52/297 |
| 1,679,297 | 7/1928 | Ehrler | 52/297 |
| 3,571,991 | 3/1971 | Doocy et al. | 52/40 |
| 3,785,107 | 1/1974 | Garretson | 52/514 |
| 4,033,080 | 7/1977 | Fukushima | 52/298 |
| 4,066,372 | 1/1978 | Swanson et al. | 52/40 |
| 4,092,079 | 5/1978 | Swanson | 52/296 |

FOREIGN PATENT DOCUMENTS

| | | | |
|---|---|---|---|
| 16408 | 2/1934 | Australia | 52/298 |
| 1229891 | 3/1960 | France | 52/298 |
| 15236 | 8/1900 | United Kingdom | 52/296 |

*Primary Examiner*—James L. Ridgill, Jr.

*Attorney, Agent, or Firm*—James B. Raden; Donald J. Lenkszus

[57] ABSTRACT

A pole includes a lower tubular steel section having a multi-sided wall. A diaphragm is disposed at a predetermined height within said lower section, and cooperates with the wall of the lower section to form a chamber for receiving a wooden upper pole section.

11 Claims, 9 Drawing Figures

POLE CONSTRUCTION

This is a continuation of application Ser. No. 43,729 filed May 30, 1979.

BACKGROUND OF THE INVENTION

1. Field of the Invention

The present invention pertains to pole structures of the type used for supporting power transmission lines, telephone wires, lighting systems and the like.

2. Description of the Prior Art

The use of wood poles in the communications and utilities industries is well-known. One advantage of wood poles over poles fabricated from other materials such as metal is their versatility. Customized on site installation of crossarms or cross bracing is accomplished in a relatively simple fashion by either drilling the poles to receive mounting hardware by use of steel mounting bands. Another important advantage is that wood poles are generally less expensive than steel poles. However, the availability of poles such as cedar in certain height categories, e.g., 70 to 100 feet, is rapidly disappearing. Accordingly, the price of wood poles beyond certain heights increases substantially and may, for certain heights, be at least as expensive as steel fabricated poles.

It is therefore desirable to provide a pole construction which can be provided at prices less than that of currently available wood poles.

A "replacement pole" arrangement is presently commercially available for replacing poles damaged by ground decay and car pole accidents and for elevation of lines and equipment on installed poles. In this arrangement, the lower, damaged section of the wooden pole is replaced while the upper section of the distributing pole including all power and telephone lines and equipment remains intact. A tapered prestressed concrete modular pole section is installed in the ground. The wooden pole is transferred onto the modular pole and is secured thereto by means of a galvanized steel connector sleeve filled with a grout.

These "replacement pole" arrangements do not appear to be particularly well adapted for providing initially installed pole structures of substantial heights. Further, concrete structures of significant length have the marked disadvantages of high weight and susceptibility to pre-installation damage.

Various techniques are known in the prior art for providing sectional poles. One such sectional pole is that of U.S. Pat. No. 3,713,262. The structure of that patent is composed of a plurality of tubular tapered sections that are locked one to each other in telescoping fashion. However, that structure is directed to metallic pole construction and is not particularly adaptable to wood pole structures.

French Pat. No. 76,767 is directed to a sectional pole and describes other structures made up of a number of tubular pieces with the lowest piece composed of either cast iron or reinforced concrete. The structure of the French Pat. No. 76,767 is a pole of two piece construction. The pole section set into the ground is cylindrical steel tube. A light metal, e.g., aluminum, section is nested on the lower section. Additional light metal sections may be added. Each section is of trapezoidal-shaped longitudinal cross-section, and as in U.S. Pat. No. 3,713,262, is adapted to nest over the lower section.

U.S. Pat. Nos. 3,217,459 and 3,839,835 teach tubular pole constructions wherein the cross-section of the pole is in the shape of a polygon. These poles are, however, of steel construction.

SUMMARY OF THE INVENTION

In accordance with the principles of the invention, a hybrid pole construction is provided wherein a metallic lower pole section is adapted to receive an upper non-metallic pole section.

In one embodiment of the invention, a lower hollow cylindrical pole section of steel includes a horizontal support sectional a predetermined distance below the top of the section. A wood pole is slipped into the upper end of the lower section and rests on the horizontal support member. The wood pole is then securely fastened to the lower section to provide lateral support.

In one particularly advantageous embodiment of the invention, the pole section is composed of twelve flat steel sides arranged in a generally circular cross-sectional configuration.

BRIEF DESCRIPTION OF THE DRAWINGS

The invention may be better understood from reading the following detailed description in conjunction with the drawings in which like reference numerals designate like parts and in which.

DETAILED DESCRIPTION OF THE DRAWINGS

Figure 1:
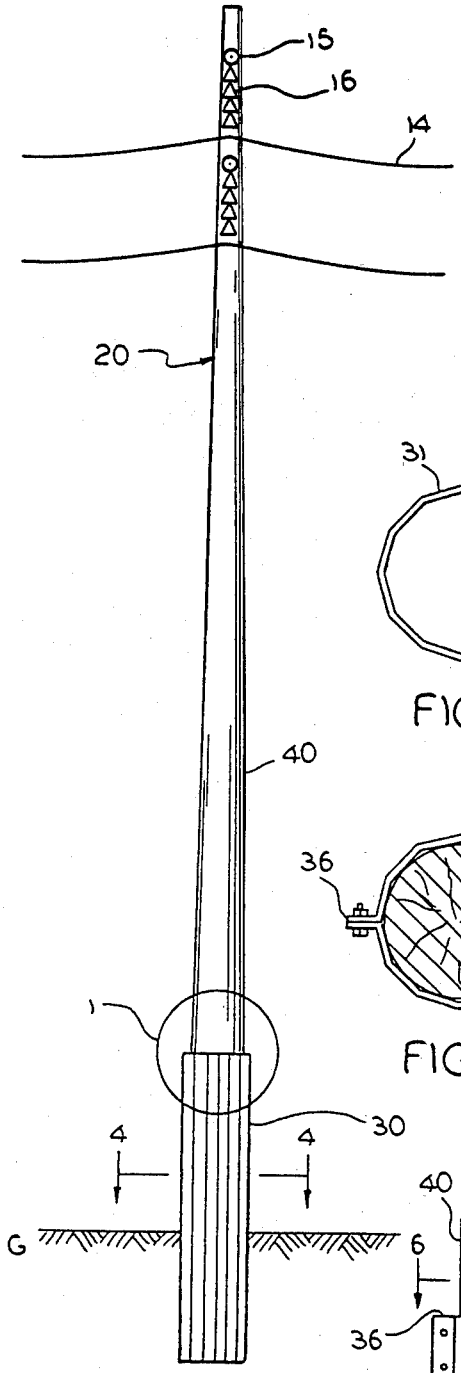
FIG. 1 is an elevational view of a transmission line pole incorporating the present invention.
Figure 2:
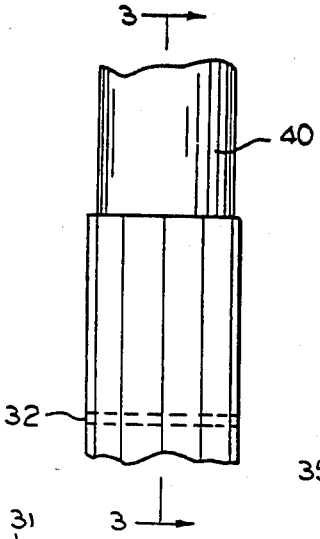
FIG. 2 is an expanded view of the encircled area 1 of FIG. 1.
Figure 3:
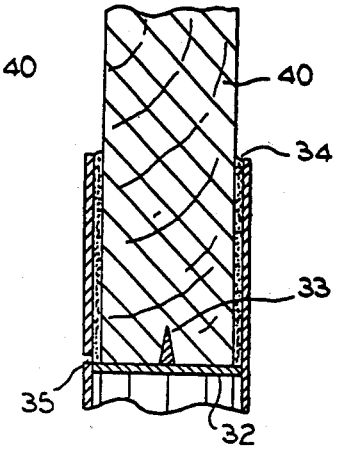
FIG. 3 is a sectional view taken along lines 3—3 of FIG. 2.

As illustrated in FIG. 1, a hybrid pole construction indicated generally at 20 is installed in the ground G.

The pole 20 is typically used to support a high voltage power transmission line 14, and accordingly, will have suitable crossarms 15 which suspend the insulators 16 on which the transmission line 14 is mounted.

The pole 20 includes a lower tubular metallic steel section 30 and an upper wood or non-metallic section 40. As shown in the drawing, the pole 20 is primarily supported by sinking the pole a predetermined distance into the ground G. If needed for a particular installation, various other well-known techniques may be provided for providing additional support such as guy wires, braces, etc. Furthermore, the pole 20 may be mounted on various support bases known in the art.

The hybrid pole 20 may also be used to replace the vertical supports in "H" type or the equivalent transmission towers.

Figure 4:
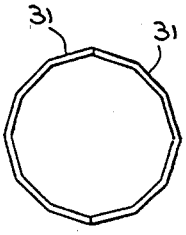
FIG. 4 is a cross-sectional view taken along lines 4—4 of FIG. 1.

The lower tubular section 30 is preferrably constructed of one or more steel plate sections 31 welded together with one or more longitudinal seams to form a tubular pole section as illustrated in cross-section in FIG. 4. A support means or steel diaphragm 32 is transversely positioned and welded in place to the interior walls of the lower tubular section 30. Diaphragm 32 provides vertical support for the upper pole section 40. One or more vertical projections 33 may be provided on the diaphragm 32 to project into the upper pole section 40.

Various arrangements may be provided for providing lateral support of the upper pole section 40 as will be described below.

The illustrative embodiment shown in FIG. 1 is designed to replace a 100 foot, Class 1 pole as defined in the Appendix to *American National Standard Specifications and Dimensions for Wood Poles,* ANSI 05.1-1972, American National Standard Institute, Inc., New York, N.Y. The lower pole section is 23 feet long with no taper and formed of 3/16 inch corrosion resistant steel plate. One steel plate section 31 is press broken to form 12 sides and is then welded together to form a substantially circular cross-sectional tubular pole having an outside diameter of 20.5 inches at the top. Each side or face is oriented at an obtuse angle with respect to adjoining sides. A steel diaphragm 32 conforming to the interior periphery of pole section 30 is formed of ¼ inch steel plate and welded in place at a distance of approximately 1½ to 2 times the diameter of the upper pole section or 3 feet in this case below the top of the pole section. For a 100 foot length pole, it is anticipated that the lower end of the steel section will be sunk approximately 11 feet into the ground.

An 80 foot long wood pole 40 is vertically supported by the diaphragm 32. One method of providing lateral support for the wood pole 40 is to pour a grout 34 between the wood pole 40 and steel pole section 30. Weep holes 35 may be provided for future drainage of moisture.

Significant cost reductions are obtained with the above-described pole construction. It is estimated that the selling price would be approximately 80% of that of a class 1 wood pole and 75% of that of a class 1 steel pole.

Figure 6:
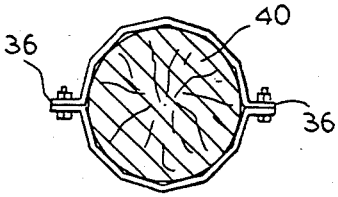
FIG. 6 is a cross-sectional view taken along lines 6—6 of FIG. 5.
Figure 5:
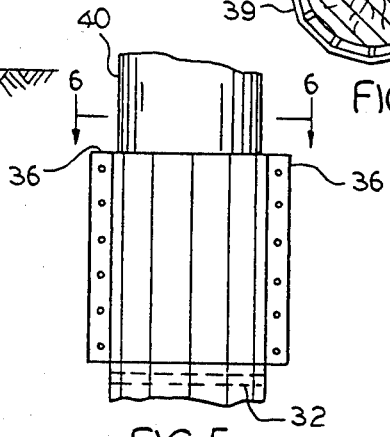
FIG. 5 is an expanded view of encircled area 1 of FIG. 1 illustrating an alternate connecting arrangement.

Alternate connection arrangements for the two pole sections are illustrated in FIGS. 5–9. As shown in FIGS. 5 and 6, at least the upper portion of the pole section 30 may be formed with ears 36 which are bolted together.

Figure 7:
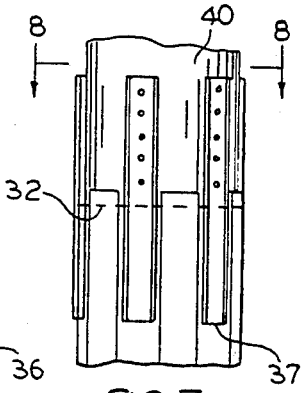
FIG. 7 is an expanded view of encircled area 1 of FIG. 1 showing another alternate connecting arrangement.
Figure 8:
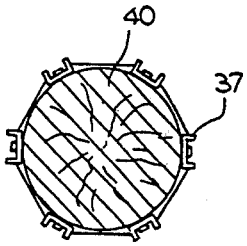
FIG. 8 is a cross-sectional view taken along lines 8—8 of FIG. 7.

Alternatively, channels 37 may be welded or otherwise fastened to the pole section 30 as shown in FIGS. 7 and 8 and fastened to the upper pole section 40 by means of lag screws or other fasteners. In this instance, it may be desirable to place the diaphragm 32 at substantially the top of lower pole section 30.

Figure 10:
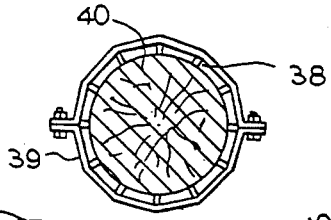
FIG. 10 is a cross-sectional view taken along lines 10—10 of FIG. 9.
Figure 9:
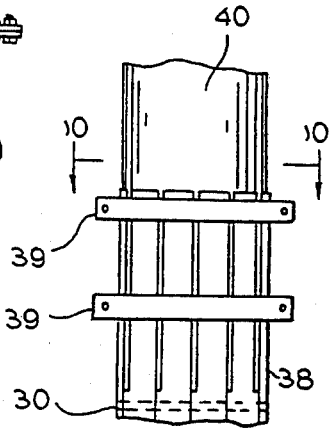
FIG. 9 is an expanded view of encircled area 1 of FIG. 1 showing yet another alternate connecting arrangement.

As shown in FIGS. 9 and 10, the upper portion of pole section 30 may have longitudinal slits 38. Steel bands 39 positioned transverse to the longitudinal axis of the pole are bolted together and draw the upper portion of pole section 30 into engagement with pole section 40.

As will be obvious to those skilled in the art, various modifications may be made without departing from the spirit and scope of the invention. For example, the lower tubular section may be of continuous cross-section or may be of polygon cross-section having a number of sides different from that shown.

What is claimed is:

1. A pole construction comprising:

a wood upper pole;

a lower pole section of tubular construction and being constructed of steel plate over its entire length, said lower pole section having one end portion adapted for insertion into the ground to a predetermined depth, said lower pole section having a continuous tubular wall with a cross section of a plurality of flat wall segments in each quadrant, each of said wall segments being oriented at obtuse angles with respect to adjoining wall segments; and a steel plate diaphragm positioned within said lower pole section, oriented transversely to the wall of said lower pole section and adapted to engage the lower end of said upper pole for vertically supporting said upper pole by transferring the weight of said upper pole to the wall of said lower pole section, said lower pole section directly transferring said weight to the ground, said diaphragm conforming to the shape of the interior periphery of said wall and being affixed to said wall, said diaphragm cooperating with the wall of said lower pole section to provide a receiving chamber for and end portion of said upper pole, said receiving chamber being filled with a grout after said upper pole is placed in said chamber.

2. A pole construction in accordance with claim 1, wherein said lower pole section is tapered convergently in an upward direction.

3. A pole construction comprising:

a non-metallic upper pole section;

a metallic, tubular lower pole section having a continuous wall comprising a plurality of flat metallic sides, each side being at an obtuse angle with respect to the adjacent sides, said lower pole section having one end portion adapted for insertion into the ground to a predetermined depth, each of said plurality of flat metallic sides extending the entire length of said one end section; and a diaphragm within said lower pole section oriented transverse to said wall of said lower pole section formed by said metallic sides and adapted to support the lower end of said upper pole section and to transfer the weight of said upper pole section to the metallic sides of said lower pole section, said metallic sides directly transferring said weight to said ground, said diaphragm conforming to the shape of the interior periphery of said wall and being affixed to said wall, said diaphragm and the portion of said lower pole section above said diaphragm forming a pole receiving chamber adapted to receiver said upper pole section.

4. A pole construction in accordance with claim 3, wherein said flat sides are of steel plate and wherein said diaphragm is of steel plate welded to said flat sides.

5. A pole construction in accordance with claim 4, wherein said upper pole section is comprised of wood.

6. A pole construction in accordance with claim 5, wherein said diaphragm includes one or more upward pointing projections adapted to penetrate the bottom of said wood pole.

7. A pole construction in accordance with claim 5 or 6, wherein the walls of said pole receiving chamber includes a plurality of longitudinal slits and said pole construction further comprises means for clamping said walls of said pole receiving chamber against said wood pole.

8. A pole construction in accordance with claim 7, wherein said clamping means comprises ears formed on each wall portion adjacent said slits and means for fastening adjacent ears together.

9. A pole construction in accordance with claim 7, wherein said clamping means comprises clamping bands around said pole receiving chamber.

10. A pole construction in accordance with claim 5 or 6, wherein the area of said pole receiving chamber between said wood upper pole and the inner wall of said lower pole is filled with a grout.

11. A pole construction in accordance with claim 10, wherein said lower pole section includes one or more drainage holes in the area of said pole receiving chamber.

* * * * *